US007601615B2

(12) United States Patent
Hayashi et al.

(10) Patent No.: US 7,601,615 B2
(45) Date of Patent: Oct. 13, 2009

(54) METHOD OF GRINDING BACK SURFACE OF SEMICONDUCTOR WAFER AND SEMICONDUCTOR WAFER GRINDING APPARATUS

(75) Inventors: Tomoo Hayashi, Mitaka (JP); Motoi Nezu, Mitaka (JP)

(73) Assignee: Tokyo Seimitsu Co., Ltd., Tokyo (JP)

( * ) Notice: Subject to any disclaimer, the term of this patent is extended or adjusted under 35 U.S.C. 154(b) by 200 days.

(21) Appl. No.: 11/590,640

(22) Filed: Oct. 30, 2006

(65) Prior Publication Data

US 2007/0105343 A1 May 10, 2007

(30) Foreign Application Priority Data

Oct. 31, 2005 (JP) ..... 2005-316248

(51) Int. Cl.
*H01L 21/30* (2006.01)

(52) U.S. Cl. ..... 438/459; 438/464; 438/692; 438/977; 257/E21.237

(58) Field of Classification Search ..... 438/459, 438/464, 692, 977; 257/E21.237
See application file for complete search history.

(56) References Cited

U.S. PATENT DOCUMENTS

| | | | | |
|---|---|---|---|---|
| 5,777,739 | A * | 7/1998 | Sandhu et al. | 356/503 |
| 5,816,895 | A * | 10/1998 | Honda | 451/41 |
| 6,075,606 | A | 6/2000 | Doan | |
| 6,368,881 | B1 * | 4/2002 | Brouillette et al. | 438/7 |
| 6,465,330 | B1 | 10/2002 | Takahashi et al. | |
| 6,572,444 | B1 * | 6/2003 | Ball et al. | 451/10 |
| 6,887,126 | B2 * | 5/2005 | Brouillette et al. | 451/6 |
| 2002/0005958 | A1 | 1/2002 | Sekiya | |
| 2002/0160691 | A1 | 10/2002 | Ishikawa et al. | |
| 2003/0029544 | A1 | 2/2003 | Noguchi et al. | |
| 2005/0070072 | A1 | 3/2005 | Priewasser | |
| 2005/0070074 | A1 | 3/2005 | Priewasser | |
| 2005/0237539 | A1 * | 10/2005 | Germanenko et al. | 356/504 |

FOREIGN PATENT DOCUMENTS

| | | |
|---|---|---|
| EP | 1 298 713 A1 | 4/2003 |
| EP | 1 548 801 A1 | 6/2005 |

(Continued)

OTHER PUBLICATIONS

Office action (with English translation) dated Sep. 20, 2007 for corresponding Korean Patent Application No. 10-2006-0106787.

(Continued)

*Primary Examiner*—Andy Huynh
(74) *Attorney, Agent, or Firm*—Christie, Parker & Hale, LLP

(57) ABSTRACT

A semiconductor wafer back-surface grinding method, for grinding a back surface of a semiconductor wafer, an opposed front surface of the semiconductor wafer being adhered to a support base material and being provided with a circuit pattern, including: measuring an initial thickness of the semiconductor wafer before grinding, in a condition where the support base material is adhered to the front surface of the semiconductor wafer; obtaining a cutting depth by subtracting a set final thickness measured after grinding from the initial thickness; and grinding the back surface of the semiconductor wafer, based on the cutting depth.

6 Claims, 2 Drawing Sheets

FOREIGN PATENT DOCUMENTS

| | | | |
|---|---|---|---|
| JP | 52-26686 | | 2/1977 |
| JP | 10-156679 | | 6/1998 |
| JP | 2001-326206 | | 11/2001 |
| JP | 2002-22417 | | 1/2002 |
| KR | 2001-0071174 | | 7/2001 |
| WO | WO 02/072311 | A2 | 9/2002 |
| WO | WO 03/043076 | A2 | 5/2003 |

OTHER PUBLICATIONS

Patent Abstracts of Japan of JP 52-026686 published on Feb. 28, 1977 in the name of Ishii et al., with a Brief Explanation thereof.

European Search Report dated Mar. 12, 2007, for EP06123110.6, in the name of Tokyo Seimitsu Co., Ltd.

Patent Abstracts of Japan, Publication No. 10-156679, dated Jun. 16, 1998, in the name of Yoshifumi Nobe.

Singapore Search Report, dated Jan. 16, 2007, for SG 200607524-6, in the name of Tokyo Seimitsu Co., Ltd.

Office Action, with English Translation, dated Jun. 20, 2008 for corresponding Korean Patent Application No. 10-2006-0106787, indicating relevance of cited references.

* cited by examiner

METHOD OF GRINDING BACK SURFACE OF SEMICONDUCTOR WAFER AND SEMICONDUCTOR WAFER GRINDING APPARATUS

CROSS-REFERENCE TO RELATED APPLICATION

This application claims priority of Japanese Patent Application Number 2005-316248, filed on Oct. 31, 2005.

BACKGROUND OF THE INVENTION

1. Field of the Invention

The present invention relates to a semiconductor wafer back-surface grinding method and a semiconductor wafer grinding apparatus for grinding the back surface of a semiconductor wafer, having a support base material adhered to a front surface with a circuit pattern formed thereon, for the purpose of reducing the thickness of the semiconductor wafer.

2. Description of the Related Art

In general, as processing methods for reducing the thickness of a semiconductor wafer, there is a method of grinding a back surface of the semiconductor wafer. For example, this method uses a grinding apparatus having a contact type sensor as an in-process gauge and, while the thickness of the semiconductor wafer is constantly monitored, grinding is performed until the wafer reaches a predetermined thickness that has been set in advance.

In this method, as shown in FIG. 3, the distance from the top surface of a turntable 2 to the back surface 3*b* of the wafer 3 is defined as the equivalent thickness (P1-P2) of the semiconductor wafer, and processing and measurement on the wafer can be performed simultaneously and in-process until the equivalent thickness (P1-P2) reaches δ1 without removing the semiconductor wafer 3 from the turntable 2, and the handling performance and the accuracy of the processing can be thereby improved.

However, in recent years, as increasingly large diameter and thin semiconductor wafers are required, due to the development of IC cards and 3-dimensional mounting, the above-described grinding method has a limitation in meeting these requirements. That is, in the above-described method of grinding the back surface 3*b* of a semiconductor wafer 3 using an in-process gauge, the semiconductor wafer 3 is directly fixed to the turntable 2, so that, when the wafer is machined until the wafer thickness δ1 is small, for example, as small as 30 μm, wafer strength is lowered and the wafer 3 is readily affected by a processing strain and this gives rise to cracking and warping.

As a solution to the above-described problem, there is a method, of grinding a back surface 3*b* of a wafer, shown in FIG. 4. In this method, a support base material 4 such as glass is adhered to front surface 3*a* of the semiconductor wafer 3, and the semiconductor wafer 3 is fixed to a turntable 2 via this support base material 4.

An example of a grinding method using an in-process gauge is disclosed in Japanese Unexamined Patent Publication No. 52-26686 (JP-A-52-26686), although it is not for grinding a semiconductor wafer, in which processing is performed while simultaneously measuring the inner diameter of a work piece with a gauge and, in accordance with the variation of size of the finished piece, a correcting command is given to the in-process control system.

When a support base material 4 is adhered to the front surface 3*a* of a semiconductor wafer 3, as shown in FIG. 4, the distance measured by an in-process gauge, that is, the distance (P1-P2) from the top surface of the turntable 2 to the back-surface 3*b* of the wafer, is the total thickness including the thickness t3 of the support base material 4 in addition to the thickness t2 of the protective surface film 5. As the tolerances (errors) of the protective film 5 and the support base material 4 are added, the single semiconductor wafer 3 cannot be finished to an accurate thickness. When a large number of semiconductor wafers 3 are continuously processed in batch processing, there is a problem that variation of the thickness of individual support base material 4 entails variation of the thickness of individual semiconductor wafers 3.

SUMMARY OF THE INVENTION

In view of above-described problem, it is an object of the present invention to provide a semiconductor wafer back-surface grinding method and a semiconductor wafer grinding apparatus, for grinding the back surface of a semiconductor wafer having a support member adhered thereto, which is capable of finishing a semiconductor wafer to an accurate thickness.

In order to attain above object, the present invention provides a semiconductor wafer back-surface grinding method, for grinding a back surface of a semiconductor wafer, an opposed front surface of the semiconductor wafer being adhered to a support base material and being provided with a circuit pattern, comprising: measuring an initial thickness of the semiconductor wafer before grinding, in a condition where the support base material is adhered to the front surface of the semiconductor wafer; obtaining a cutting depth by subtracting a final thickness measured after grinding from the initial thickness; and grinding the back surface of the semiconductor wafer, based on the cutting depth.

According to this invention, by measuring the initial thickness of the semiconductor wafer before grinding, a cutting depth can be obtained by subtracting the final thickness after grinding from the initial thickness, and by grinding the back surface of the semiconductor wafer fixed on the turntable based on this cutting depth, the influence of the thickness of the support base material and thickness of the surface protective tape can be eliminated and the semiconductor wafer can be finished to an accurate thickness.

In order to attain the above object, the present invention provides a semiconductor wafer grinding apparatus, for grinding a back surface of a semiconductor wafer, an opposed front surface of the semiconductor wafer being adhered to a support base material and being provided with a circuit pattern, the apparatus comprising: a first measuring section for measuring a initial thickness of the semiconductor wafer before grinding, in a condition where the support base material is adhered to the front surface of the semiconductor wafer; a cutting depth obtaining section for obtaining a cutting depth by subtracting a final thickness measured after grinding from the initial thickness; and a machining grinding section for grinding the back surface of the semiconductor wafer based on the cutting depth.

According to this invention, as the grinding apparatus includes the measuring section for measuring the thickness of the single semiconductor wafer before grinding, the cutting depth can be obtained by subtracting the final thickness, after grinding, from the thickness before grinding. By grinding the back surface of the semiconductor wafer fixed on the turntable based on this cutting depth, the influence of the thickness of the support base material and thickness of the protective film can be eliminated, and the single semiconductor wafer can be finished to an accurate thickness.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Figure 1:
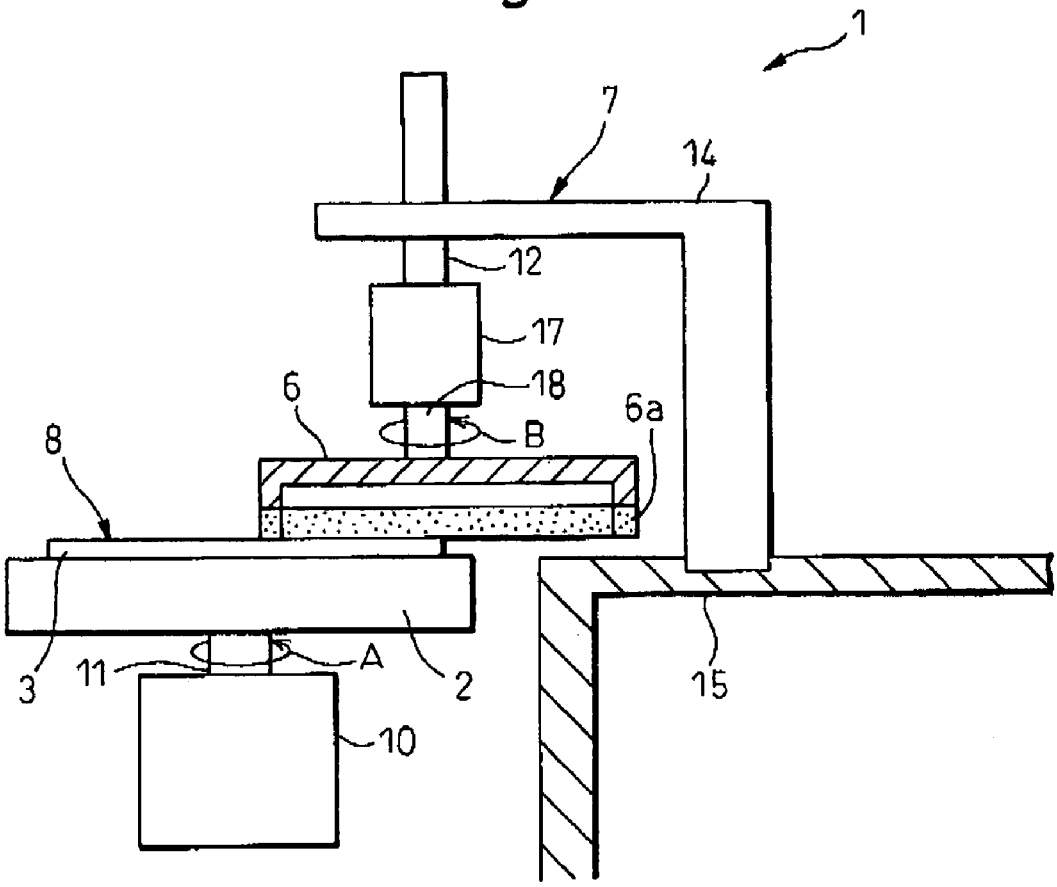
FIG. 1 is a view useful for explaining a semiconductor wafer back-surface grinding method according to an embodiment of the present invention.
Figure 2:
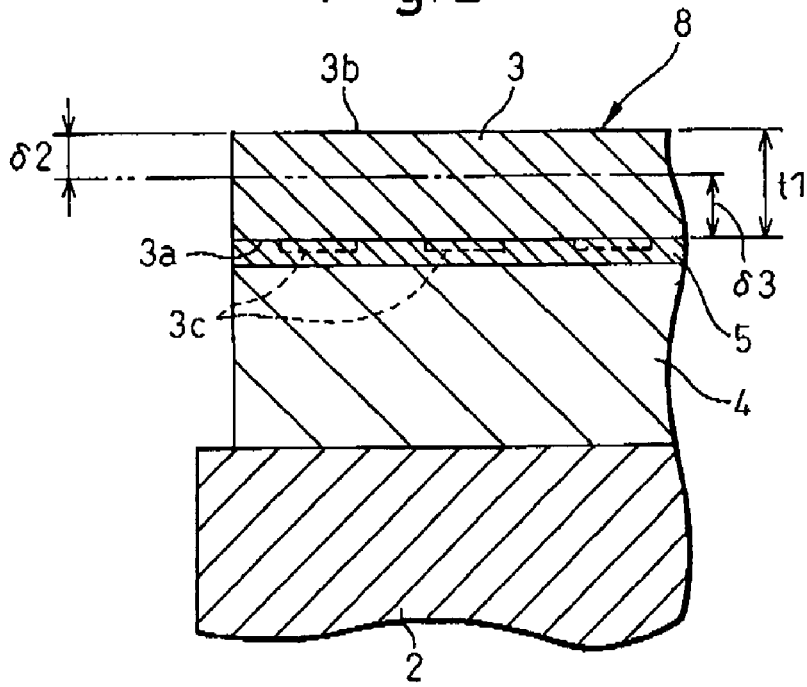
FIG. 2 is an enlarged sectional view showing the semiconductor wafer shown in FIG. 1.
Figure 3:
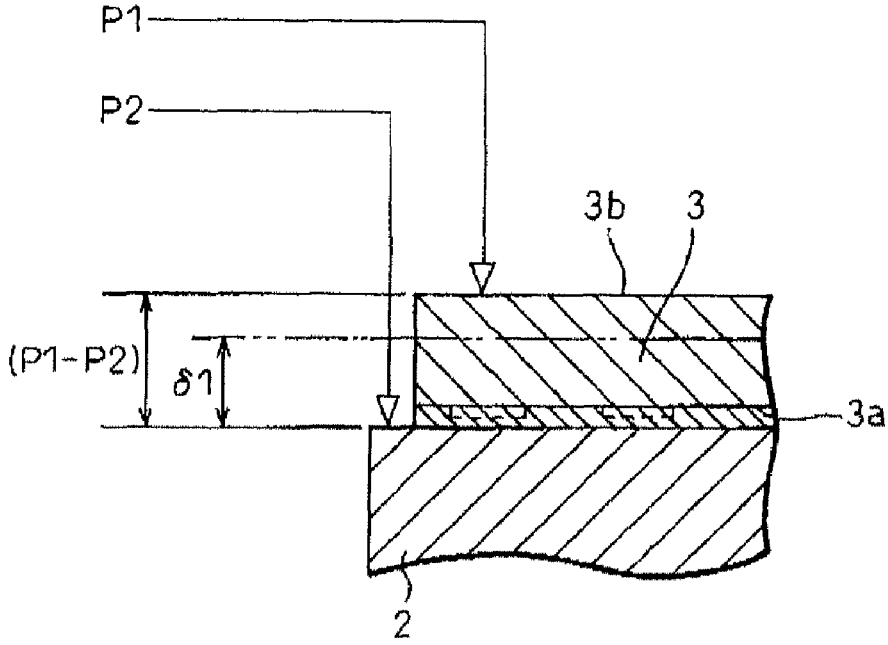
Fig. 3 (PRIOR ART)
FIG. 3 is a view useful for explaining an example of conventional semiconductor wafer back-surface grinding method.

The semiconductor wafer back-surface grinding method and the semiconductor wafer grinding apparatus according to the present invention will be described in detail with reference to the appended drawings showing preferred embodiments thereof. FIG. 1 and FIG. 2 are views useful for explaining a semiconductor wafer back-surface grinding method according to an embodiment of the present invention. Common constituents are denoted by the same reference numerals.

As partially shown in FIG. 1, the semiconductor wafer grinding apparatus 1 includes a turntable 2 for supporting the semiconductor wafer 3, a cup-type grinding wheel 6 (a grinding section), a spindle head 7 for rotatably supporting the grinding wheel 6, an unshown IR (Infrared Ray) sensor as a first measuring section, and an unshown in-process gauge as a second measuring section.

As shown in FIG. 2, the semiconductor wafer 3 is detachably held on the turntable 2 with glass base material (support base material) 4 adhered to the front surface 3*a* having circuit pattern 3*c* formed thereon. For example, before grinding, the thickness t1 of the semiconductor wafer 3 measured with an IR sensor is about 750 μm, the thickness of the protective film 5 is about 100 μm, and the thickness of the glass base material 4 is about 1 mm. The semiconductor wafer 3 can be ground to a thickness as thin as 30 μm, for example, based on the cutting depth δ2 that is determined from the thickness t1 of single wafer for each wafer, In the present embodiment, the combined wafer member 8 is composed of a semiconductor wafer 3, a protective film 5, and a glass base material 4. In another embodiment, the combined wafer member 8 may be composed of a semiconductor wafer 3, and a glass base material 4. The combined wafer member 8 may be composed with account being taken of the thickness of adhesive between the protective film 5 and the glass base material 4.

Next, referring to FIG. 1, each of the constituents of the semiconductor wafer grinding apparatus 1 according to the present embodiment will be described. The turntable 2 is formed in the shape of a disk, and an output shaft 11 of a motor 10 is mounted to its lower surface concentrically with the center axis of the turntable 2. The turntable 2 is rotated by the driving force of the motor 10 in the direction of the arrow A in the Figure. On the upper surface of the turntable 2, an unshown suction plate (chuck) is provided, and the glass base material (support base material) 4 to be adhered to the semiconductor wafer 3 is adapted to be sucked to this suction plate under a vacuum. The semiconductor wafer 3 can be thereby held on the turntable 2, and rotated by the turntable 2. After grinding, the semiconductor wafer 3 can be easily removed from the suction plate by supplying air to the suction plate.

As the glass base material, a glass material having material properties similar to those of the semiconductor wafer 3 is preferred in order to avoid occurrence of a processing strain during the grinding process due to a difference in the material properties of the two materials. The thickness of the glass base material 4 is determined depending on the thickness of the semiconductor wafer 3, and any thickness may be selected.

The grinding wheel 6 is for grinding the back surface 3*b* of the semiconductor wafer 3 held by suction to the turntable 2, and may, for example, be a cup-type diamond grinding wheel with a liquid bond as a binder. By using a liquid bond as a binder, the grinding wheel becomes resilient so that the shock at the time of contact of the grinding wheel 6 with the wafer 3 may be reduced and the wafer back-surface 3*b* can be ground to high precision. The grinding wheel 6 is mounted to the spindle head 7 with the grinder portion 6*a* facing downward.

An output shaft 18 of a motor 17 is attached to the upper surface of the grinding wheel 6 and is concentric with the center axis of the grinding wheel 6, and the grinding wheel 6 is rotated by the driving force of the motor 17 in the direction of an arrow B in the Figure. The grinding wheel 6 attached to the spindle head 7 is subjected to truing, on the apparatus, so as to form the wheel surface opposed to the wafer 3. Also, dressing is performed to generate a sharp cutting edge on the surface of the wheel 6 that has been degraded in cutting performance.

The spindle head 7 is composed of the motor 17, a ball screw 12, and the like. By driving the ball screw 12 with an unshown motor, the grinding wheel 6 can be moved up and down relative to the semiconductor wafer 3. Thus, by abutting and pressing the grinding wheel 6 to the back surface 3*b* of the semiconductor wafer 3 and feeding the grinding wheel 6, the back surface 3*b* of the semiconductor wafer 3 can be ground by the grinding wheel 6.

The ball screw 12 is fixed on a ram 14 that is formed in L-shape. The ram 14 may be of a movable type or a fixed type. The ram 14 of the present embodiment is a fixed type.

The IR sensor makes use of a property of infrared rays, that infrared rays are transmitted through metals, glass, and plastics, to measure the reflection time of infrared rays reflected at the boundary of the semiconductor wafer 3 and the glass base material 4 or the protective film 5 in order to obtain the thickness t1 of the single wafer as shown in FIG. 2. The IR sensor is provided on the grinding apparatus as a measuring system composed of a stage unit having an unshown data analyzer and a probe, and a power controller, etc.

Figure 4:
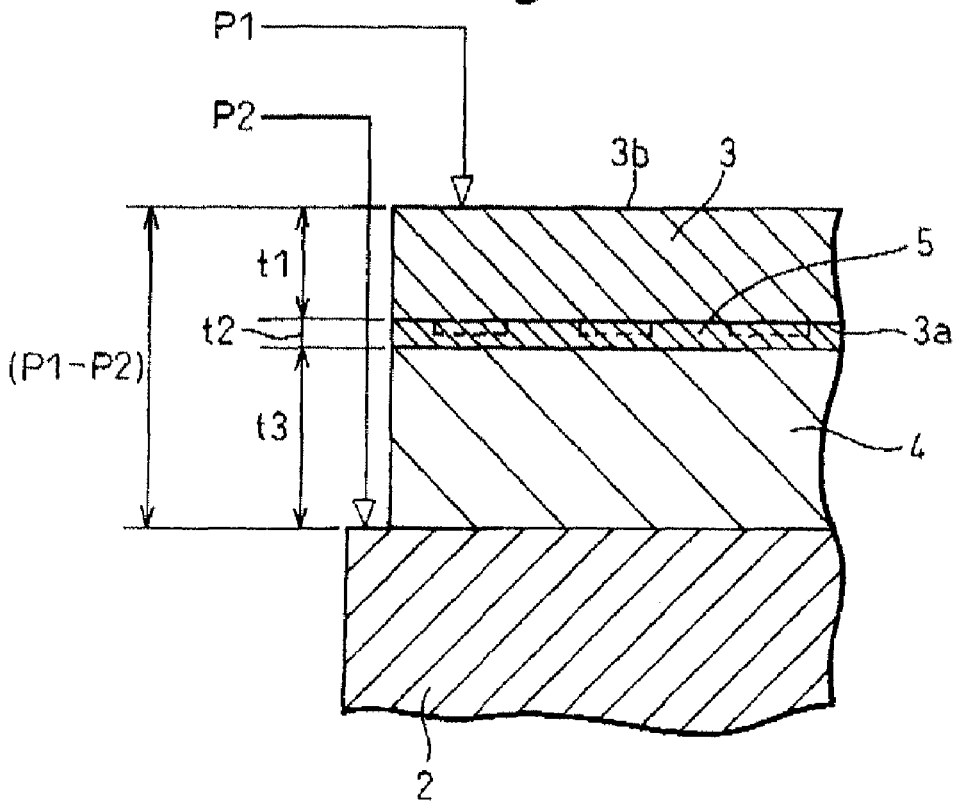
Fig. 4 (PRIOR ART)
FIG. 4 is a sectional view showing a semiconductor wafer having a glass base material adhered thereto that is ground by the same method as in FIG. 3.

The in-process gauge is a so-called touch sensor of a contact type and is a measuring device in which a displacement of the probe as a contact plunger is converted to voltage signal by a differential transformer, and the distance (P1-P2) between the top surface of the turntable 2 and the wafer back-surface 3*b*, that is, the thickness of the combined wafer 8, is performed based on the converted voltage signal (see FIG. 4) in process. For example, an in-process measurement using the in-process gauge is performed in each case, when processing finished by one-path. Although the distance (P1-P2) varies for each individual combined wafer 8, grinding is performed to a position determined by subtracting the cutting depth from the distance (P1-P2), so that every semiconductor wafer 3 can be ground always to the same thickness.

Next, the method of grinding the back surface 3*b* of the semiconductor wafer 3 using the semiconductor wafer grinding apparatus 1 will be described. First, the thickness t1 of the semiconductor wafer 3 integrated with the glass base material 4 is measured, using the IR sensor, before grinding. Then, cutting depth δ2 is determined by subtracting the final thickness (a set value) δ3 of the wafer 3 from the measured value (an initial thickness) of the wafer thickness t1. The cutting depth δ2 is inputted to an unshown controller for controlling the grinding apparatus based on the cutting depth.

As shown in FIG. 2, the combined wafer 8 is held on the upper surface of the turntable 2 with the glass base material 4 adhered to the front surface 3*a* of the semiconductor wafer 3. Next, while the semiconductor wafer 3 is rotated by the motor 10, the grinding wheel 6 attached to the spindle head 7 is rotated by the motor 17. Then, the ball screw 12 is driven to move the grinding wheel 6 downward. The grinder portion 6*a* of the grinding wheel 6 is abutted and pressed to the back surface 3*b* of the semiconductor wafer 3 and, for each rotation of the turntable 2, the grinding wheel 6 is moved downward by a predetermined cutting depth to grind the back surface until the cutting depth δ2 is removed off from the thickness t1 of the semiconductor wafer 3.

When grinding of the back surface 3*b* has been completed, the grinding wheel 6 is retracted from the semiconductor wafer 3, and the motor 17 is stopped to stop the rotation of the grinding wheel 6. The grinding process with the grinding apparatus 1 is thereby finished.

After the grinding process has been finished, with the semiconductor wafer 3 still fixed on the turntable 2, polishing is performed using an unshown polishing apparatus to remove a damaged layer generated by grinding process. This can prevent damage, such as an inadvertent crack, from being produced in the wafer 3. After polishing has been completed, the semiconductor wafer 3 is removed from the turntable 2, transferred to next process such as wafer processing, and coating or dicing of the wafer is performed.

In accordance with the semiconductor wafer grinding apparatus 1 according to the present embodiment and a method of grinding the back surface 3*b* of a semiconductor wafer using the same, by measuring the thickness t1 of the semiconductor wafer 3 with an IR sensor before grinding, the cutting depth δ2 of the wafer 3 can be obtained. By grinding the wafer back-surface 3*b* fixed on the turntable 2 based on this cutting depth δ2, the influence of the thickness of the glass base material 4 and the thickness of the protective film 5 can be eliminated, and individual single semiconductor wafer 3 can be ground and finished to an accurate thickness.

The present invention is not limited to the above-described embodiment, but can be implemented in various modifications and variations without departing from the concept of the invention. Although, in the present embodiment, the wafer thickness t1 is measured before the semiconductor wafer 3 is held on the turntable 2, the wafer thickness t1 may be measured after the semiconductor wafer 3 has been mounted on the turntable 2.

Although the grinding apparatus 1 of the present embodiment comprises an in-process gauge, other measuring section may be used in place of the in-process gauge as long as the measuring section are capable of measuring the position of the back surface of the semiconductor wafer 3 fixed on the turntable 2.

Although an IR sensor is used in the present embodiment, another non-contact type sensor or, if possible, another contact type sensor, may be used as long as the thickness t1 of the single semiconductor wafer 3 can be measured before grinding.

The invention claimed is:

1. A semiconductor wafer back-surface grinding method, for grinding a back surface of a semiconductor wafer, an opposed front surface of the semiconductor wafer being adhered to a support base material and including a circuit pattern, the method comprising:

adhering said semiconductor wafer to said support base material;

measuring an initial thickness value of the semiconductor wafer before grinding using an IR sensor, in a condition where the support base material is adhered to the front surface of the semiconductor wafer, wherein the measured initial thickness value excludes a thickness of the support base material;

calculating a cutting depth value by subtracting a desired thickness value after grinding from the measured initial thickness value; and grinding the back surface of the semiconductor wafer, based on the calculated cutting depth value.

2. A semiconductor wafer back-surface grinding method according to claim 1, further comprising fixing the semiconductor wafer to a turntable, before measuring the initial thickness value of the semiconductor wafer.

3. A semiconductor wafer back-surface grinding method according to claim 1, wherein the initial thickness value of the semiconductor wafer is measured using the IR sensor to measure the reflection time of infrared rays reflected at the boundary of the semiconductor wafer and the support base material.

4. A semiconductor wafer grinding apparatus for grinding a back surface of a semiconductor wafer, an opposed front surface of the semiconductor wafer being adhered to a support base material and including a circuit pattern, the apparatus comprising:

a first measuring section for measuring an initial thickness value of the semiconductor wafer before grinding, in a condition where the support base material is adhered to the front surface of the semiconductor wafer, wherein the measured initial thickness value excludes a thickness of the support base material;

a cutting depth obtaining section for calculating a cutting depth value by subtracting a desired thickness value after grinding from the measured initial thickness value; and a grinding section for grinding the back surface of the semiconductor wafer based on the calculated cutting depth value.

5. A semiconductor wafer grinding apparatus according to claim 4, further comprising a second measuring section for measuring, in an in-process mode after fixing the semiconductor wafer on a turntable, a distance from the top surface of the turntable to the back surface of the semiconductor wafer.

6. A semiconductor wafer grinding apparatus according to claim 4, wherein the first measuring section comprises an IR sensor.

* * * * *